US006070314A

United States Patent [19]

Pithon

[11] Patent Number: 6,070,314

[45] Date of Patent: Jun. 6, 2000

[54] METHOD AND APPARATUS FOR THE COAXIAL CONNECTION OF A COUPLER AND A REINFORCEMENT BAR

[75] Inventor: Jean-Marie Pithon, Paris, France

[73] Assignee: Dextra Europe, Paris, France

[21] Appl. No.: 08/976,332

[22] Filed: Nov. 21, 1997

Related U.S. Application Data

[63] Continuation-in-part of application No. 08/654,772, May 29, 1996, abandoned, which is a continuation of application No. 08/375,364, Jan. 19, 1995, abandoned.

[51] Int. Cl.[7] ..... B21D 39/04

[52] U.S. Cl. ..... 29/283.5; 29/282; 72/370.02

[58] Field of Search ..... 29/517, 282, 520, 29/515, 516, 283.5; 72/370.02, 391.2

[56] References Cited

U.S. PATENT DOCUMENTS

| | | | |
|---|---|---|---|
| 2,852,843 | 9/1958 | Banta et al. | 29/517 |
| 3,545,264 | 12/1970 | Bourgeois et al. | 29/517 X |
| 3,559,270 | 2/1971 | Beghi | 29/517 X |
| 3,732,715 | 5/1973 | Zamorano | 29/517 X |
| 3,824,665 | 7/1974 | Saito | 29/282 X |
| 5,315,755 | 5/1994 | Fulbright et al. | 29/709 X |

FOREIGN PATENT DOCUMENTS

| | | | |
|---|---|---|---|
| 1012920 | 7/1952 | France | 29/517 |

*Primary Examiner*—Joseph M. Gorski
*Attorney, Agent, or Firm*—Harrison & Egbert

[57] ABSTRACT

A device for coaxially connecting a coupler to a reinforcement bar including a threaded joint tool for the attachment of the coupler by the threaded portion of the coupler, a hollow double action jack body, and an extrusion tool. The extrusion tool is translatable along the axis of the coupler so as to allow for regular deformation of the material of the coupler in order to induce the connection on a reinforcement bar. A counter-pressure device is provided on the coupler so as to exert a force on the coupler in an opposite direction to that which is applied by the extrusion tool. The counter-pressure device serves to induce the connection of the coupler on the reinforcement bar by automatically controlling the elongation of the material of the coupler induced by the force of the extrusion.

3 Claims, 3 Drawing Sheets

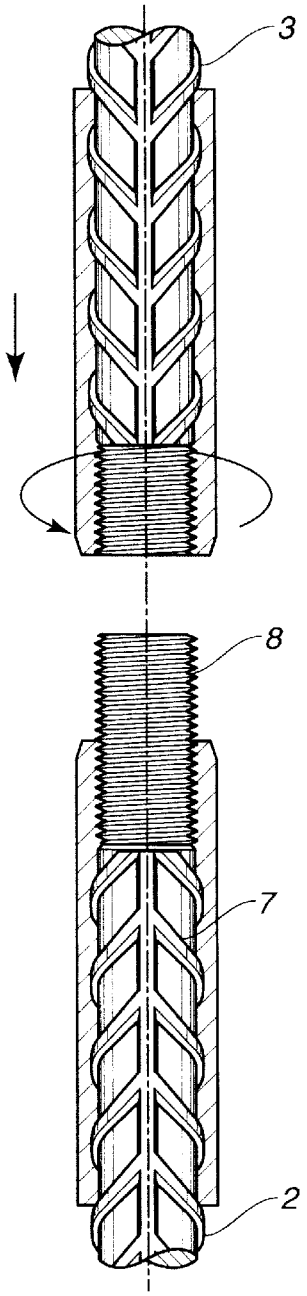
FIG. 1
Prior Art
FIG. 2
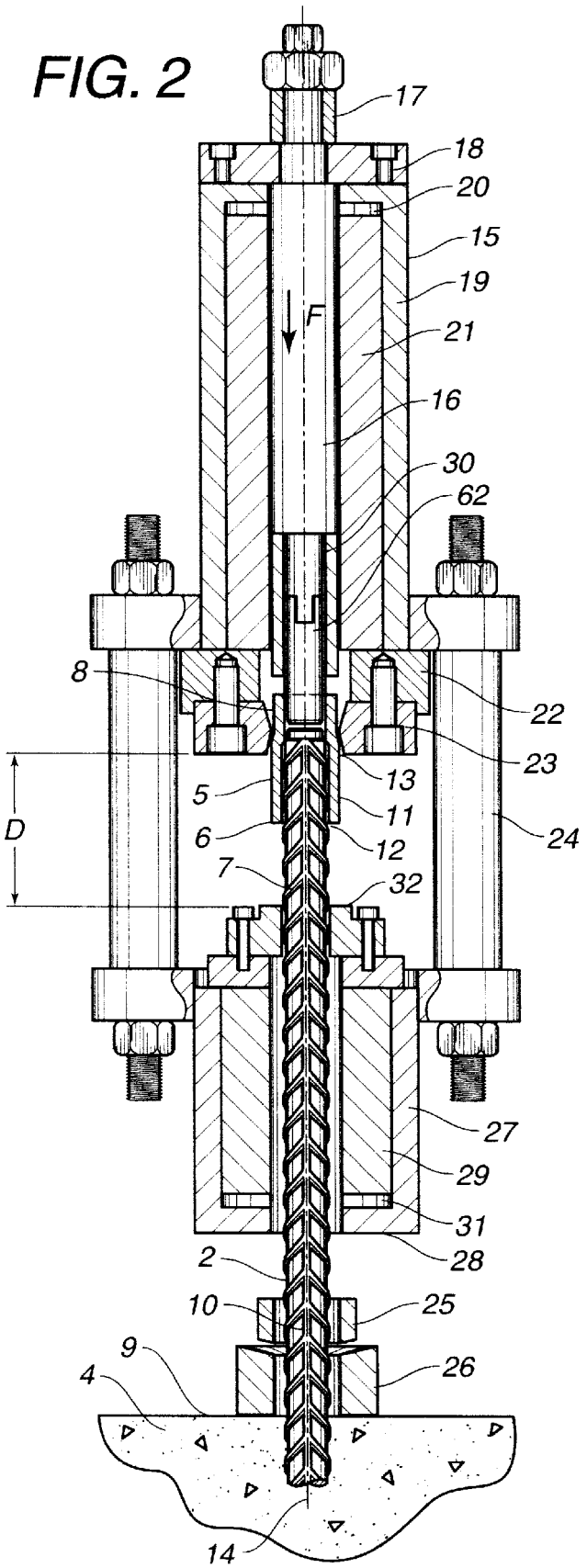

METHOD AND APPARATUS FOR THE COAXIAL CONNECTION OF A COUPLER AND A REINFORCEMENT BAR

RELATED APPLICATION

The application presented here is a continuation-in-part of U.S. patent application Ser. No. 08/654,772, filed on May 29, 1996, now abandoned, and entitled "Mechanical Connection for Reinforcing Bars, Device for Placing This Mechanical Connection and Process for Fixing the Mechanical Connection for Reinforcing Bars." U.S. application Ser. No. 08/654,772 was a file wrapper continuation of U.S. application Ser. No. 08/375,364, filed on Jan. 19, 1995, and entitled the same, now abandoned.

TECHNICAL FIELD

The invention presented here involves a device for the coaxial connection of a coupler on a reinforcement bar which will be applied notably in the area of the construction of structures using concrete such as buildings or substructures.

BACKGROUND ART

In this application area, the use of mechanical connections for connecting reinforcement bars, in order to ensure the transmission of mechanical stresses in a continuous manner, is known. These reinforcement bars have nervures or ribs on their external surface. The nervures or rubs have dimensions which are rather irregular but are of course proportioned relative to the diameter of the bar.

Presently, it is known to connect these bars by spot-connecting using a tube jointing sleeve which is crimped over by pressing. For this it is necessary to use awkward shaped exterior clamping jaws since the system which uses a clamping jaw that wraps by external pressure must be powerful. This obstruction is a disadvantage when the concentration of reinforcement bars is increased because if two reinforcement bars are very close together, it is not possible to act rapidly on the construction site.

It is also to be noted that after the clamping jaws are actuated by external pressure in order to connect the two reinforcement bars end to end, it is not possible to verify and test if the operation has been correctly performed. Trust must then be placed in the operator's skill.

Known devices, as in the technique described in the European patent number 0.098.099, which connect perpendicularly, i.e. radially, to the reinforcement bars by successive passes, act in an unpredictable manner because they don't know exactly whether the bar will be applied in a cross or in a nervure. It is thus necessary to use sleeves of considerable length, on the order of 200 to 250 millimeters, and you cannot ensure that all the connections will be made in a good condition.

The result of the connection actually depends on the pressure applied by the operator and each successive positioning of the tool. Also, too strong a connection may damage the end of the reinforcement bar. In summary, modern devices do not ensure that the modifications of the geometry, and thus the mechanical properties, experienced by the coupler and the bar, are constant during connection, regardless of which reinforcement bar-coupler combination is connected.

Moreover, it is necessary to consider that the reinforcement bars meet the very broad geometric and dimensional standardized tolerances as for their dimensions and rib shapes. Large dimensional variation between different reinforcement bars of the same rated diameter are observed as a result. These differences and dimensional and geometric imperfections also involve variations of the mechanical resistance characteristics for each of the coupler connections on the reinforcement bars.

The known devices are also in most cases manually activated and very slightly mechanized. Because of this, they require a considerable involvement by one or more operators. Many consequences of this absence of automization are harmful with regard to efficiency and productivity of the modem devices.

First of all, the labor cost of performing the connection of couplers on reinforcement bars is very high since it requires the involvement, during the entire operation, of one or more operators. The productivity is often low and the operation of connecting requires considerable time. The wage cost is all the more considerable in that, taking into account the technical particulars and the quality requirement in the performance of the connection of couplers onto the reinforcement bars, the operator must in most cases have suitable training and be sufficiently qualified to perform the connection operations.

Moreover, the known devices use a perpendicular connection with a mobile clamping jaw and a fixed matrix which also leads to a quasi-obligatory misalignment of the two bars to be connected, because the two reinforcement bars are not aligned taking into account the asymmetry and the irregularity of their forms and their dimensions. This misalignment, by turning the traction forces into bending moment and into shear stress, is very detrimental to the mechanical performance of the connections.

Another disadvantage of the modem devices and techniques is that they totally separate the connection phase is itself and the quality control phase of the connections made.

It clearly appears that the assemblies of couplers on reinforcement bars must meet very strict requirements with regard to mechanical resistance, and principally, the resistance to traction. Actually, it is essential for the safety of the constructions that the connections established between the reinforcement bars have very considerable mechanical resistance properties and are, to say the least, as extensive as those of the reinforcement bars themselves.

In order to ensure the quality of the connection, it is necessary to make numerous tests, more often than not of the traction since it is the form of the mechanical stresses which predominates in the use of reinforcement bars. These tests are currently only performed in specialized laboratories.

The traction tests currently performed are particularly costly since they are carried out outside of the production site of the coupler connections onto the reinforcement bars and since they require the additional human involvement of highly qualified personnel.

Moreover, the tests currently performed do not allow periodic or random checks of the different connections. Given the costs of the tests, the necessity of performing them in the laboratory and the time they take, it is currently impossible to check the mechanical characteristics of each of the links made by connection between the couplers and the reinforcement bars. This aspect constitutes a very basic disadvantage of the modem devices since they do not ensure an optimal security of each of the links made by connection given that the traction tests are made in a non-systematic manner.

This disadvantage is all the more harmful since the devices and the techniques of connection currently in use are largely manual. Actually, human involvement makes it so that each connection made has specific and individual characteristics. In fact, it must be recognized that the operator can not repeat all of the connection operations in an absolutely identical manner and that as a result, the mechanical properties of the connections made vary for each coupler reinforcement bar combination.

The traction tests currently performed are often planned in advance. The operator thus knows if the connection that he is going to make will be checked or not. He would then have, of course, the natural tendency to take more care in the connections when the connection is designated for a check. This subjectivity is again detrimental to the overall safety of the connections couplers-reinforcement bars. Thus, the exterior laboratory involves some samples prepared such that there is not, strictly speaking, a security of certainty, taking into account the manipulations which can be performed during the performance of these tests.

As a consequence, the realization of the traction tests, in the laboratory and in a non-systematic manner, does not allow for total certainty as for good mechanical resistance of each of the coupler-reinforcement bar connections.

As a consequence, the devices and the techniques of the modem connection make it difficult to obtain certification in the context of a policy of quality assurance.

Recently, one has seen the development, in numerous industries, of a strategy of quality development in the goal of obtaining an official certification which is the assurance of quality of its activities.

The connection devices of couplers on reinforcement bars currently in use makes such an accreditation difficult. Actually, the accreditation must apply, on the one hand, to the material used for the connection, but also to the quality of the human involvement in performing the connection.

Another disadvantage of the present devices is that they make it difficult to adapt to the deviations and dimensional or geometric imperfections of the reinforcement bars. The tolerances imposed for the manufacture of the reinforcement bars are actually vary large and it is not rare, for example, to notice that a reinforcement bar having an external diameter of 30 millimeters effectively measures 1 or 2 millimeters more or less. Present devices which are less mechanized and do not absolutely use automatic methods do not permit adapting the procedure of the extrusion operation as a function of its dimensional and geometric variations.

In the case where the external diameter of the reinforcement bar is greater than the theoretical diameter, the force imposed on the material of the coupler during crimping is found increased and the plastification of the material is more important.

In the case where the external diameter of the reinforcement bar is less than the theoretical diameter, the force of the crimping will be less important and will lead to modifications of the mechanical properties of the coupler which are totally different from the preceding case. Thus, the present devices do not ensure that during connection, the modifications of the mechanical characteristics to which the coupler is subjected are constant regardless of the assembly reinforcement bar-coupler which is set.

This disadvantage again reinforces the individuality that makes up each coupler-reinforcement bar connection, which is harmful in that it concerns the assurance of the quality of the connection made and greatly puts into perspective the result of the laboratory tests on the samples prepared especially for this purpose.

It thus appears that the present devices which allow the connection of the couplers onto the reinforcement bars unequipped with the reinforcement component do not completely give a satisfactory result. By virtue of these numerous disadvantages, the crimped connection coupler-reinforcement bar is currently a technique of limited diffusion given the interest peculiar to links by connection of couplers onto reinforcement bars.

The purpose of the invention presented here is to compensate for the aforementioned disadvantages and to allow connecting a reinforcement bar whose end does not have any means of connection such as a threading. This lack of threading can be due to corrosion or quite simply to the fact that no mechanical connection has been forecasted in the design. It may also be that this mechanical connection has been cut inadvertently on the construction site.

An advantage of the invention presented here is that it includes particular methods allowing on the one hand, a bending and support of the coupler and on the other hand, connection by displacement of a transfer mold along the axis of the coupler, without transmission of the force to the reinforcement bar.

Another significant advantage of the device presented here is in manufacturing a perfectly regular connection by monitoring that the deformation of the coupler is done in a homogeneous manner over the entire surface, whatever the dimensional tolerance of the reinforcement bar and the shape of its sides.

SUMMARY OF THE INVENTION

The invention presented here provides an automatic check of the elongation of the coupler material brought about by the extrusion force in order to adapt it to the deviations and dimensional and geometric imperfections which the reinforcement bars exhibit and to achieve a connection giving the same modifications of the mechanical properties of the coupler regardless of the initial imperfections of the rebar.

This advantage also contributes to the optimization of the quality of the connections of the couplers-reinforcement bars. It actually constitutes an additional stage of standardization of the connections of the couplers-reinforcement bars and allows homogenization of the mechanical properties of each of the connections.

Another important innovation of the device according to the invention is in manufacturing and monitoring each of the connections of the couplers-reinforcement bars in a manner such that their mechanical properties and their quality are guaranteed.

In order to achieve this goal, the invention presented here provides notably the implementation of totally automatic means in order to carry out the connection and a traction test.

According to the invention, the whole cycle of connection which constitutes the positioning of the coupler fitted onto the reinforcement bar in the device and the extrusion operation is carried out, strictly speaking, without human involvement as soon as the cycle is started, and in a totally automatic manner.

This automation makes it possible to avoid all risk of user error, both in terms of the connection operation and the traction test operation. The automatic methods used according to the invention make it possible to carry out the connection and the traction test in a completely identical manner for all connections of the couplers-reinforcement bars. The manufacture of connections of the couplers onto the reinforcement bars having different characteristics from one another, as is inevitable in the case of a manual device, is thus prevented.

The invention also has the advantage of avoiding all risk of user error. Actually, the job of the operator is limited to the operation of the start-up of the cycle since all he has to do is insert the reinforcement bar into the device and take it out again at the end of the operation after the connection and traction test.

Moreover, all of the parameters which occur in the cycle of the connection and the traction test are fixed by the selection of the type of tool to be positioned. As soon as the operator has positioned a tool corresponding to a predetermined diameter of the reinforcement bar, the device according to the invention manages all of the values to be given as the parameters of the cycle.

Thus, any risk of operator error is avoided both in the selection of the level of load necessary for the connection and in that which will test the coupler connection on the reinforcement bar. As a consequence, the quality of the connection and the assurance the mechanical resistance to traction are guaranteed.

This combination, in a same device, of the automatic means of connection and the traction tests, is particularly interesting. It makes the sequence of the two operations logical since it does away with all intermediate manipulation on the reinforcement bar. Actually, the connection cycle and the traction test cycle follow on in an automatic manner on the same site and in the same device.

It is no longer necessary to prepare and transport the reinforcement bars into a specialized laboratory, often far from the manufacturing site or construction site, after connection. The combination of the automatic methods of connection and the traction test thus allow reducing the overall cost of the operation.

Moreover, by making it possible to check each coupler-reinforcement bar connection, the invention is particularly advantageous since it again increases the mechanical security of the connections and their quality.

A result of this check of each mechanical connection is that it is not possible to manufacture, and afterwards to use, connections of couplers-reinforcement bars of poor quality. Actually, if the traction test which follows systematically after the connection turns out to be unfavorable, the coupler-reinforcement rod connection is then immediately ruled out by automatic disconnection of the coupler and the reinforcement bar.

In this manner, the invention makes it possible to obtain a certification of quality assurance in an easy way.

The certification is obtained if all of the manufacturing phases of the reinforcement rod-coupler connections meet the very strict quality specifications. In the context of the invention, the conditions are met since the device it describes makes it possible to obtain, in a totally automatic manner, a connection and a very rigorous monitoring of the connection.

The invention presented here combines all of the connections and traction tests in the same device. There is thus no human intervention whatsoever in the process of the cycle after the start-up of the cycle and there is no change in the device. The certification of quality assurance therefore only applies to the device according to the invention which avoids having to certify, at the same time, the quality of the operator and the quality of the sequence of the connection operations and the traction tests.

In addition, by making it possible to carry out a traction test for each coupler—reinforcement bar connection and in making it possible to record or back-up the data of each of the tests, the invention presented here ensures a complete traceability of each of the coupler reinforcement bar connections.

Another goal of the invention is to make it possible to manufacture destructive tests in manner which is random, periodic, or started manually.

The performance of the destructive tests has the advantage of making it possible to verify that it is the reinforcement bar which breaks, i.e. that its maximum stress at rupture is lower than that of the connection of the coupler on the reinforcement bar. According to the invention, this destructive test may be carried out either by starting it manually or in an automatic manner. In this case, it is possible to program a destructive test in a periodic manner or a random manner.

Another goal of the device according to the invention is to be able to greatly increase the quantities of the connections formed which could reach 400 a day instead of the 40 of today. The device can be installed at a fixed position in the workshop, or on the construction site, in order to industrialize the preparation of the reinforcement bars.

The operator has the time during the automatic cycle to take the next reinforcement bar and to insert the coupler onto it. Thus, the productivity is increased since the time required for the operation is reduced and since the connection and the traction test are performed in an automatic manner which is faster than manual.

In addition, the invention presented here can be used by an operator without special qualifications.

Other goals and advantages of the invention presented here appear in the process of the description which is to follow and, however, is only given as a rough guideline.

The invention presented here involves a device for the coaxial connection of a coupler onto a reinforcement bar. The coupler includes an external or internal threaded part at one of its ends and a hollow cylindrical part in which the end of the reinforcement bar is introduced, designed to integrate the coupler and the reinforcement bar in order to contribute to the constitution of the mechanical connection between the two reinforcement bars placed end to end, notably used in the field of construction, of building and infrastructure works, the device including:

- a threaded joint tool for the attachment of the coupler by its external or internal threaded part,
- a hollow double action jack body,
- an extrusion tool,
- translation mechanisms of the extrusion tool along the axis of the coupler, allowing regular deformation of the material of the coupler in order to induce the connection on a reinforcement bar,
- and counter-pressure mechanisms of the coupler making it possible to exercise a force on the coupler in the opposite direction to that which is applied by the extrusion tool in order to induce the connection of the coupler on the reinforcement bar by automatically controlling the elongation of the material of the coupler induced by the force of the extrusion, as a function of the imperfections and the dimensional and geometric deviations of the reinforcement bar. Additionally, the device can include a mechanism that can perform a tensile test on the connection that is made.

BRIEF DESCRIPTION OF THE DRAWINGS

FIG. 1 shows the mechanical connection implemented on the two reinforcement bars.

FIG. 2 is a view of the device according to the invention based on a first embodiment form.

DETAILED DESCRIPTION OF THE INVENTION

Figure 3:
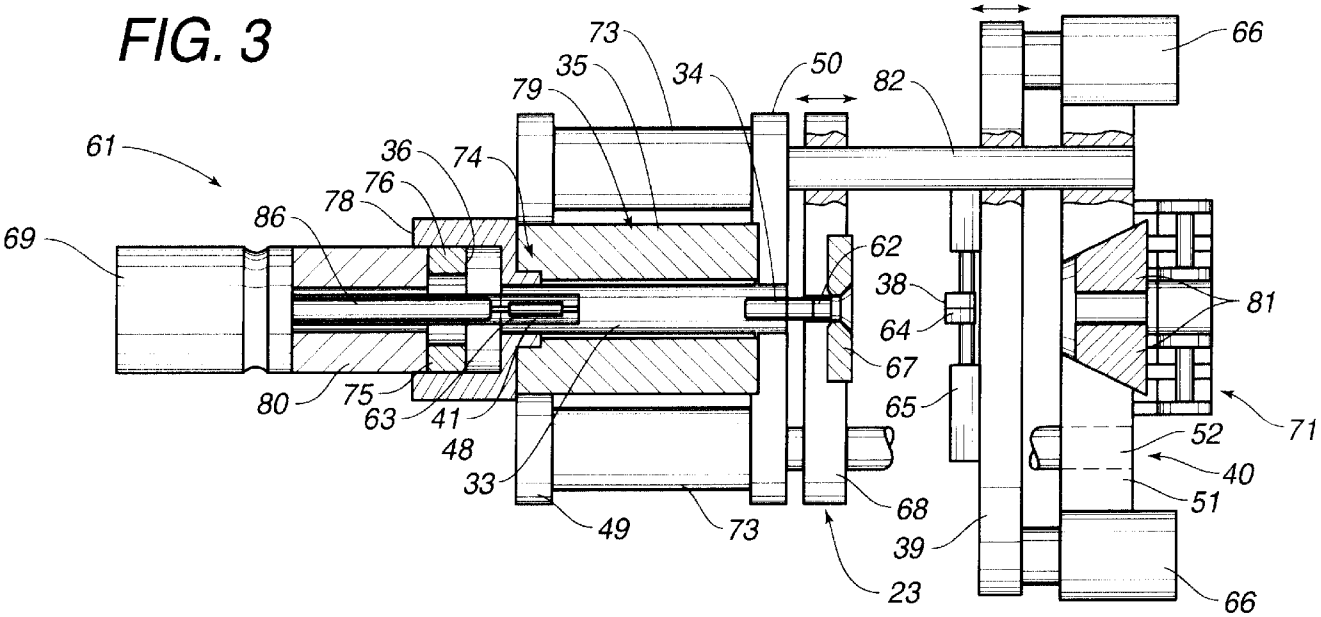
FIG. 3 shows the device in another automated embodiment form.

Reference is made to FIG. 1 which shows a mechanical connection of a reinforcement bar, generally designated by the reference indicator (1). This reinforcement bar known to the expert is widely used today on construction sites to support constructions. An attempt is made to connect the reinforcement bar (2) with another bar (3) which will be arranged coaxially with the bar (2). The connection (1) thus ensures a transmission of the traction force in a known manner between the bar (2) and the bar (3).

The present invention, as shown in FIG. 2, includes a threaded joint tool (62). This tool allows the attachment of a coupler (11) onto the device (61) in cooperation with the threaded part (8). The support of the coupler (11) during the connection, and possibly the traction test, is thus ensured.

The device also has a transfer mold (23) which ensures the connection by the required deformation at the contact with the coupler (11).

In order to create a regular connection along the axle (14) of the bar (2), the device (61) includes the translation mechanisms of the extrusion tool (23).

All of the mechanisms are described more precisely in the following and make it possible to avoid any take-up of axial force by the reinforcement bar (2).

Two variations of the device are described here based on the fact that a design device which is very light is desired, such as is illustrated in FIG. 2, or a completely automated device is desired, such as is illustrated in FIG. 3. These two preferred embodiment forms are considered in sequence.

According to a first embodiment form which is simple and light, and thus easy to handle on-site, reference is made to FIG. 2, which shows the reinforcement bar (2) with its end (7) unequipped with any connection component and notably of threads, and stationary, for example, because it has already been fitted into the concrete (4). This reinforcement bar has on its external surface, ribs (10) designed to make it easier to support the bars in the concrete when they are subjected to mechanical stresses. These ribs (10) have dimensions and irregular and variable spaces according to the diameter and origin of the reinforcement bar.

The mechanical connection (1) of the reinforcement bars includes a coupler (11) with a hollow cylindrical part (5) in which the end (7) of the bar is inserted into the hole (12).

In an embodiment form, the coupler (11) has a cylindrical form on a large part of its height but it also shows a chamfered part (13), the end of the coupler (11) has, beyond the chamfered (13), a threaded part (8) also represented in FIG. 1.

The threaded part (8) may be external or internal as required. It is to be noted that the bar (2) and the threads (8) are arranged coaxially along the axis (14) in order to be able to make an end to end connection of the bars (2) and (3).

The different components of the mechanical connection (1) are, of course, made in metal but a material could be advantageously chosen for the coupler (11) which is more malleable than the material which makes up the reinforcement bar (2) and this in the goal of causing the penetration by plastic deformation of the coupler material (11) between the ribs (10) while a pressure is exerted on the external surface of the coupler (11).

According to the embodiment form, the device includes the translation mechanisms of the extrusion tool made up of a hollow double action jack (15), includes a body (19) and a piston (21). To this has been joined, at the end (22) of this piston (21), an extrusion tool (23) which can be a variable form, circular for example, or with offset grains, or also with balls. This extrusion tool (23) may in some cases be controllable according to the diameter of the bar to be connected. The connection could be controlled by adjusting the number of balls and by possibly creating a circular movement in order to make possible a connection according to a helicoid pattern.

The threaded joint tool (62) is a tube extension piece (16) which is threaded at one of its ends (30) fitted into the external or internal threaded part (8) of the end of the coupler (11). The tube extension piece (16) has threading (17) at its other end: this threading (17) comes to mount in the end (18) of the hollow jack body used preferably in double action. The body (19) of this jack defines, by the tube extension piece (16), a space (20) in which a hollow piston (21) may be moved.

The extrusion tool (23) is applied first on the chamfer (13) then to the assembly of the external periphery (5) of the coupler (11) by a considerable pressure transmitted by the piston (21). It is this pressure and the simultaneous deformation of the periphery of the coupler (11) which induces the connection of the coupler (11) to the end (7) of the reinforcement bar (2).

In the case where it has balls or grains, the extrusion tool (23) creates striations in a sufficient number as preferred on the external part of the coupler, distributed over the entire periphery. The number of striations will of course be a function of the diameter of the bar to be connected.

The extrusion tool (23), during its axial, and possibly circular displacement over the distance D illustrated in FIG. 2, will plastically deform the material of the coupler (11) and, by pressure, also induce its penetration between the ribs (10) of the reinforcement bar at the level of is end (7). This penetration is made possible by the selection of material making up the coupler (11) to be more malleable than the material of the bar (2).

The device according to the invention also consists of the counter-pressure mechanisms (24, 27, 29, 32) of the coupler (11) which make it possible to exert a force on the coupler in the opposite direction to that which is applied by the extrusion tool (23) illustrated by the letter F in FIG. 2.

In order to do this during the connection operation, a second hollow double action jack (27) placed opposite from the jack (15) and behind the body (19) by the rods (24), applies a force of counter-pressure directly opposite in direction to the force F applied by the jack (15) to the base (6) of the coupler (11). By adjusting the pressure in the chamber (31) and the displacement of the piston (29) of the jack (27) by a valve, the force of the counter-pressure applied by the adapters (32) on the base (6) of the coupler (11) is controlled, and thus the deformation of the material of the base under the influence of the force F applied by the extrusion tool (23). One can thus adapt this deformation to the dimensional and geometric variations of the reinforcement bar (2) and of its ribs (10) in such a way as to guarantee penetration of the material of the coupler (11) between the ribs (10) and to obtain a constant connection quality.

During the displacement of the piston (21) in the direction of the arrow F, the end of the extrusion tool (23) moves along the axis (14) of distance D. The base (28) of the jack (27) of the counter-pressure comes into contact with a socket component (25). This component is itself positioned on a socket plate (26).

At the end of the operation, this socket component (25,26) ensures that the base (28) of the jack of the counter-pressure (27) comes to support the axis (14) of the reinforcement bar perpendicularly no matter what the condition of the surface (9) of the concrete (4), and the jack (15) pulls at a pre-established value, for example, of 99% of the elastic limit of the reinforcement bar. This test will be considered good if, during the traction exercised, no sliding of the coupler (11) is observed relative to the bar (20). This sliding is detected and noted by a drop in the oil pressure read on the manometer.

If the connection has not been performed in good application conditions, the connection (1) will become undone during the test and it would be better that this be at that moment in order to avoid the later inconveniences on the construction site. It would be necessary to either redo it or to replace it.

It is observed that the device for connecting the coupler (11) onto a reinforcement bar (2), which has been described, is very compact and that it acts along the axis (14) of the bar which is above its. Thus, one can easily use it on a construction site where the reinforcement bars have already been put into place without any other connection mechanism having been provided and in regions where the space is reduced and where there is a significant concentration of reinforcement bars.

It is noted that the forces induced by the extrusion tool (23) are returned to the coupler (11). The axial force induced by the jack (15) is absorbed by the coupler (11) and it is not necessary to have a sizable press frame to absorb it. There are couplers which integrally receive the force of the connection, contrary to the known devices where the coupler does not play this reaction role during the connection. Here the coupler (11) plays a functional reaction role during the operation and work can be done in the air without considerable tools or support.

The length of the coupler (11) and the distance D over which the connection is made naturally depends on the density and the size of the ribs (10) and the protruberances on the bar (2) as well as the diameter of the bar and the operational method, the cold, the heat, longitudinal only or helicoid.

According to a second embodiment form, the connection and the traction test are done in an entirely automatic manner; reference is made to FIG. 3 which illustrates the device (61) based on this possibility.

The device (61) for the connection of a coupler (11) on a reinforcement bar (2) according to the invention thus consists of the automatic connection mechanisms. These automatic mechanisms make it possible to create the connection of the couplers (11) on the reinforcement bars (2) while assuring the quality of the connections.

In a particular embodiment form, the automatic mechanisms of connection include the mechanisms (33,62,63,69, 75,76,79) for positioning the coupler (11). These mechanisms make possible the automatic positioning on the threaded joint tool (62) of the coupler (11). They also ensure the unscrewing of the coupler at the end of the cycle.

Based on an embodiment possibility, the mechanisms (33) for positioning the coupler (11) are shown in the form of a solid shaft (33) of the threaded joint tool (62). This shaft includes the support of the threaded joint tool (62) and its replacement, notably if the diameter of the coupler (11) is changed to position it on the threaded joint tool (62). The shaft (33) is preferably made in a manner in order to be mobile in rotation and in translation along its main axis.

The device (61) also has a extrusion tool (67) which ensures, at the contact with the coupler (11), its connection by the plastic deformation which it imposes on it.

In a particular embodiment form of the invention, the shaft (33) is mobile in translation along the axis (14) by the guide mechanisms (79). These guide mechanisms (79) could be made up by a hollow jack (79) with a body made up by an external envelope (35). In this manner, the hollow jack (79) allows for mobility of the shaft (33) in translation along the axis (14) and also in rotation. The external envelop (35) allows the attachment of a hollow jack (79) on the structure (49,50) of the device (61).

According to an embodiment form, the rotation mechanisms (69, 86) of the shaft (33) are made up by a motor (69) which drives a transmission shaft (86) by rotation. The transmission shaft (86) is linked in rotation to the shaft (33) in a manner to drive it.

The motor (69) can be electric or hydraulic. Its power and its rotational speed are chosen in a manner to fit it to good threading of the threaded part (8) of the coupler (11) on the threaded joint tool (62).

In order to control the start of rotation of the shaft assembly (33)—threaded joint tool (62), the invention, in a particular embodiment form, is made up of mechanisms (75, 76) for detection of the presence of the shaft (33) in an advanced or retracted position.

As shown in FIG. 3, the position sensor (76) is placed relative to the upper end (36) of the shaft (33) while the shaft is in an indented position. This shaft position (33) corresponds to the state of rest, i.e. when the shaft (33) is not moved compared to the hollow jack (79).

The second capacity sensor (75) is placed a little more upstream from the device (61) in a manner of being opposite the upper end (36) of the shaft (33) while the shaft is in an advanced position. The advanced position corresponds to the case where the shaft (33) is translated compared to the hollow jack (79).

The detection mechanisms (75, 76) of the presence of the shaft (33) thus make it possible to determine if the shaft (33) is displaced compared to its resting position which is the distant position where it reenters into the hollow jack (79).

In an additional embodiment form, the invention includes the reaction mechanisms (63) of the shaft translation (33). These mechanisms could be made up, for example, of a pneumatic or hydraulic jack (63) mounted at the end of the transmission shaft (86) and applied to the upper end (36) of the shaft (33).

The reaction mechanism (63) make it possible to obtain a spring effect in order to displace the shaft (33) in translation.

The device (61) of automatic connection also is made up of an extrusion tool (23) such as is shown in FIG. 3. The extrusion tool (23) most often includes a die (67) and a die holder (68) ensuring the support of the die (67) and the possibility of fitting many diameters or types of dies (67) on the machine (61).

The die (67) is of an existing design and its diameter is chosen in a manner in order to fit it to the external diameter of the coupler (11) to be mounted. The threaded part (8) of the coupler (11) may be inserted in the die (67) up to the neck (13) of the coupler (11).

The device (61) according to the invention also includes the translation mechanisms (73) of the extrusion tool (23) along the axis of the coupler (11). In the particular embodiment form shown in FIG. 3, the translation mechanisms (73) are made up by at least one extrusion jack (73) interdependent with the extrusion tool (23). One or more of the extrusion jacks (73), for example, hydraulic ones, having axes parallel to the axis of the coupler, can be used.

The device (61) also includes the counter-pressure mechanisms (64,65,66) allowing the automatic control of the elongation of the material of the reinforcement bar (2) induced by the force of the extrusion, as a function of the imperfections and the dimensional and geometric deviations of the coupler (11). In this manner, the constancy of the modifications of the mechanical properties which the reinforcement bar (2) experiences during extrusion are guaranteed.

Figure 5:
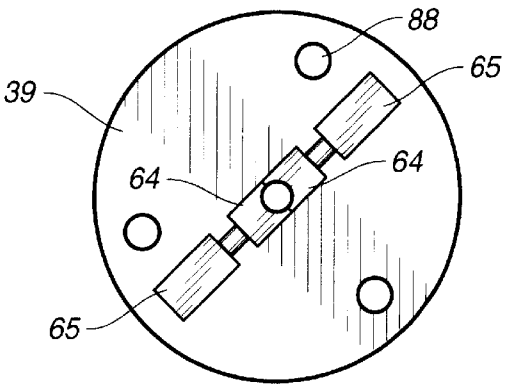
FIGS. 5 and 6 show the device for controlling the elongation in a particular embodiment form.

According to one embodiment, the counter-pressure mechanisms (64, 65, 66) are made up by two jacks of radial translation (65), at least one push jack (66) and two female molds (64) such as shown in FIG. 5.

Figure 6:
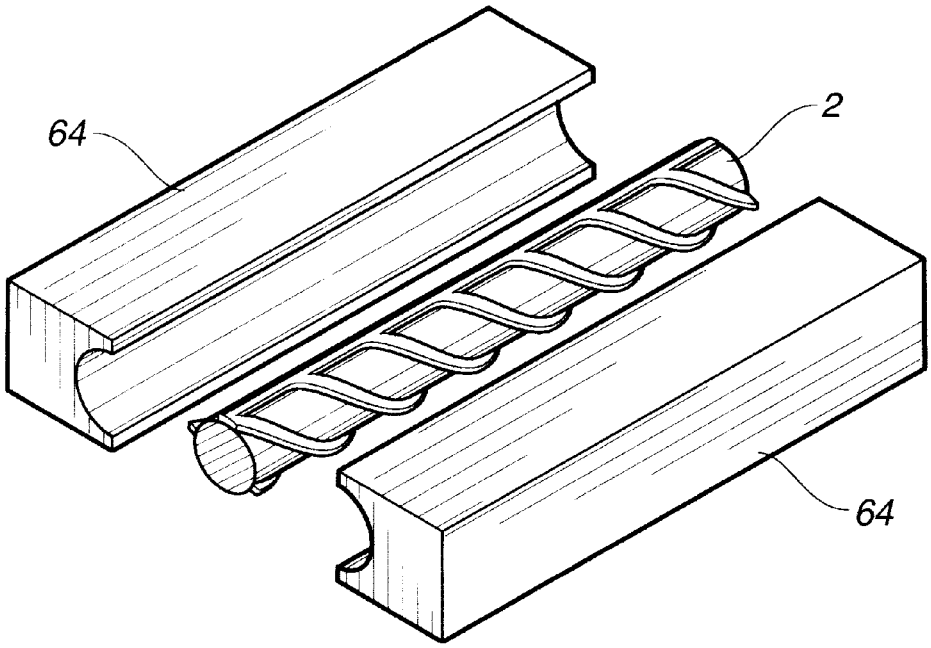

The two female molds (64) make it possible to make a support by their upper side (38) on the base of the coupler (11). The variable but are preferentially adapted to the dimensions of the coupler (11) and of the reinforcement bar (2) as is shown in FIG. 6.

In order to support the upper side (38) of the female molds (64) and the coupler base (11), the two push jacks (66) oriented along the axis of the coupler (11), such as shown in FIG. 3, can be used, for example.

Based on the example of FIG. 3, the female molds (64) and the jacks of the radial translation (65) are mounted on a collar (39). Based on the embodiment form, the collar (39) includes the base of the support of the female molds (64) and the jacks of the radial translation (65), and allows, by supporting the push jacks (66) on the surface of this collar (39), the translation of the female molds (64) along the axis (14) of the device (61).

The push jacks (66) are preferably equipped with a sensor allowing the conservation of the pressing force that they exert at a constant value. Based on this configuration, the control of the pressing force is made by an advanced or retracted displacement of the piston of the push jacks (66). In this manner, by varying the position of the one of several push jacks (66), the force of the counter-pressure applied to the coupler (11) and starting the elongation of the metal of the coupler (11) is controlled.

In its automated version, the device (61) for the connection of a coupler (1I) onto a reinforcement bar (2) according to the invention can also be made up of automatic mechanisms of traction tests which make up the self-check mechanisms In a preferred embodiment form, the traction test cycle is carried out automatically consecutively at the conclusion of the connection cycle. The control of the test is thus systematic following the start-up of the connection by manual pressure from the operator on the reinforcement bar (2).

The automatic mechanisms of the traction test make it possible, when the connection operation is completed, to check the mechanical resistance to traction, of the coupler connection onto the reinforcement bar (2).

The automatic mechanisms of the traction test generally includes locking mechanisms (71) of the reinforcement bar (2) and stress mechanisms (74) in traction of the coupler (11). These latter mechanisms make it possible to test the mechanical resistance to traction up to the level of the preset load or up to the rupture either of the connection formed between the coupler (11) and the reinforcement bar (2) by connection, or of the reinforcement bar itself.

Figure 4:
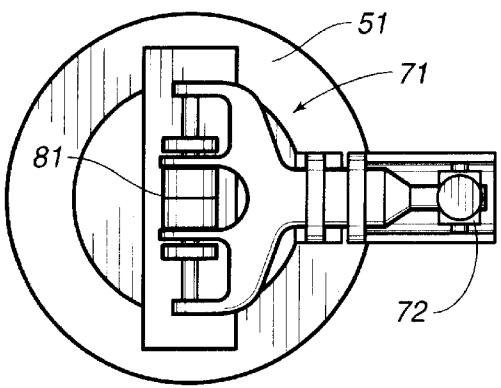
FIG. 4 shows the support device of the reinforcement bar in a particular embodiment form.

According to a particular embodiment form of the invention, the locking mechanisms of the reinforcement bar (2) includes a vice (71) such as shown in FIG. 4.

FIG. 4 shows the embodiment of a vice (71) placed at the end of the device (61) opposite the positioning mechanisms (33, 62, 63, 69, 75, 76, 86) of the coupler (11). Its opening and closing is preferentially controlled by a control jack (72).

In the particular embodiment form, the vice (71) includes clamping jaws (81) at the inclined bearing area allowing the complete locking of the reinforcement bar (2) during the traction test. FIG. 3 shows the clamping jaw (81) supported on an included solid bearing surface of the structure (40) of the device (61). The clamping jaw (81) preferentially has sides which can form a support on the external diameter of the reinforcement bar (2).

The vice (71) thus described allows for the complete locking of the reinforcement bar (2) via its clamping jaws (81). This locking can be controlled in an automatic manner by a control jack (72).

In order to perform the traction test, the stress mechanisms (33, 34, 74) are combined with the locking mechanisms (71) in traction of the coupler (11). According to a particular fon-n, the stress mechanisms (33,34,74) are manufactured with an intermediary piece (78). As shown in FIG. 3, the intermediary piece (78) is placed between the external envelope (35) of the hollow jack (79) and the shaft (33). The intermediary piece (78) makes up a guide for the displacement of the shaft (33) in order to create the guide mechanisms of the shaft (33). The intermediary piece (78) is fixed on the hollow piston of the jack (79) allowing for translation in the external envelope (35).

According to this configuration, the hollow jack (79) is formed of an external envelope (35), a solid intermediary piece (78) of its piston and of the shaft (33). The stress mechanisms (33,34,74) are thus created by translation of the intermediary piece (78) in the external envelope (35) of the hollow jack (79). This translation is carried out by blocking the mobility of the shaft (33) opposite the intermediary piece (78) and notably via a collar (48) formed on the shaft (33) designed to come to stop on the flat side made on the intermediary piece (78).

According to a particular embodiment form of the invention, the motor (69) and the transmission shaft (86) are supported by means of a solid support of the intermediary piece (78). In this manner, during the traction test, it is the assembly made of the threaded joint tool (62), the shaft (33), the intermediary piece (78), the transmission shaft (86) and the motor (69) which is driven by a translation along the axle of the coupler.

According to another embodiment form of the invention, at least one return movement jack (80), having a body integrated into the structure (40), makes it possible to absorb the displacement of the piece (78) when the traction test causes the rupture of the reinforcement bar (2) or the coupler (11)—reinforcement bar (2) connection. FIG. 3 schematizes the embodiment of a central return movement jack (80) having a piston which can produce an absorbing support on the intermediary piece (78).

The return movement jack (80) also has, for the return function, the shaft (33) in the re-entry position in the external envelope (35) of the hollow jack (79) at the end of the traction test. These dimensions and their characteristics will be adapted to the force which may be furnished in order to absorb the displacement of the shaft (33).

The different components making up the device (61) could be mounted and supported by a structure (40) making up the frame of the device (61).

According to an alternative form shown in FIG. 3, the structure (40) includes fixed collars (49,50,51) mounted in an integrated manner via the bars (52).

The fixed collars make it possible, notably, to support the extrusion jacks (73), the external envelope (35), the positioning mechanisms (33,62,63,69,75,76,79,86) and the blocking mechanisms (71) of the reinforcement bar (2). Preferably, they have forms an dimensions similar to those of the die holder (68).

According to the preferential form of the invention, the automatic mechanisms of the connection and the automatic mechanisms of the traction test are controlled in a centralized manner by a Programmable Logic Controller (PLC). This Programmable Logic Controller can direct the sequential progression of all the connection operations and the traction tests and the adaptation of the parameters of the connection cycle and the tests as a function of the diameter of the coupler.

The Programmable Logic Controller also makes it possible to control the parameters of the cycle, notably as a function of the diameter of the coupler (11). The parameters of the cycle includes notably:

the speed of the motor (69)

the translation speed of the translation mechanisms (73) of the extrusion tool (23) adjusted using hydraulic pressure, the force of the counter-pressure applied by the counter-pressure mechanism (64,65,66) on the base of the coupler (11), and the level of the load at which the traction test is performed, i.e. the maximum load generated by the stress mechanisms (74).

In manual mode, these different parameters can be controlled manually by the operator. Nevertheless, they can be preferably automatically adjusted according to the diameter of the die (67).

The parameters of the cycle described above are more often than not preset for an external diameter of the reinforcement bar. The diameter of the die (67) is fitted to the external diameter of the coupler (11), the selection made by the operator of a die (67) makes it possible to automatically determine what the external diameter of the reinforcement bar to be inserted is and to adjust the parameters of the connection cycle and tests. According to the example of FIG. 7, the extrusion tool (23) additionally includes a die (67) and a die holder (68), a locating device of the diameter of the die (67) linked to a Programmable Logic Controller.

Figure 7:
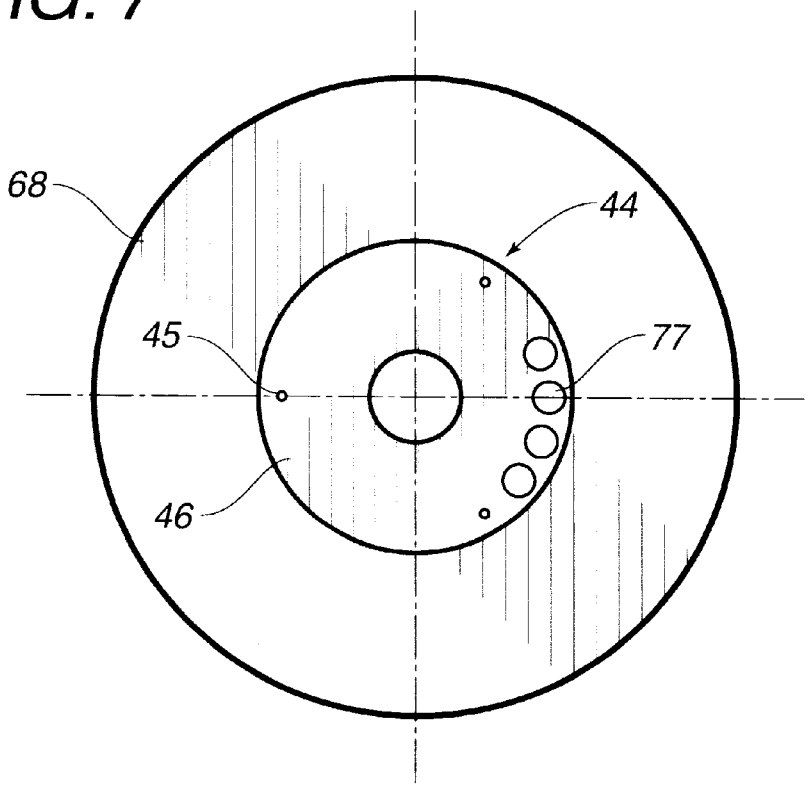
FIG. 7 schematizes an embodiment example of the extrusion tool.

The locating device of the diameter of the die (67) consists according to the invention of position sensors (77) fixed on the die holder (68) as shown in FIG. 7. The position sensors (77) are notably inductive sensors. These position sensors deliver binary information according to the presence or absence of a mark.

These marks are distributed in a preset manner but differently on the surface of each die (67). Their position is chosen in a manner to be able to place them opposite some position sensors (77).

The locating device according to the invention also includes a positioning device (44) which makes it possible to mount in a unique manner, the die (67) on the die holder (68). The positioning device (44) includes, for example, of a position lug (45) which agrees with a cavity made on the surface of the die (67), and of the mounting screws (46) which allows the attachment of the die (67) onto the die holder (68). the presence of a position lug (45) makes possible only the mounting of the die (67) on the die holder (68). In this manner, a particular die corresponds to a particular state of functioning of the position sensors (77).

Thus, a combination of the detection state of the position sensors (77) corresponds to a die (67) and thus to a coupler (11) diameter. The message made up of the binary information issued from the position sensors (77) can be transmitted to the Programmable Logic Controller in order to adapt the parameters of the cycle of the connection and the test as a result.

The Programmable Logic Controller also makes it possible to record the change in the traction force and the change in the displacement of the stress mechanism (74) during the traction test. Thus it is possible to save the data for each traction test.

The Programmable Logic Controller also makes it possible to manage the performance of the destructive tests in a periodic or random manner. It also makes it possible to know the value of the traction force corresponding to the rupture of the reinforcement bar (2) or the connection of the coupler (11) on the reinforcement bar (2).

The connection device of the coupler (11) onto a reinforcement bar (2) according to this creation mechanism allows the automization of the creation of the connection of the coupler (11) onto the reinforcement bar (2) guaranteeing the quality of the connections while limiting the 30 human involvement to a minimum.

According to the invention, cycle means the sequence of the following operations.

First of all, the die (67) is placed on the device (61) corresponding to the diameter of the coupler (11) to be inserted. Then, the reinforcement bar (2) is readied by inserting it into the hollow cylindrical part (5) of the coupler (11). The assembly formed in this manner can be introduced in the device (61) until contacting the threaded part (8) of the coupler (11) with the threaded joint tool (62). Then, the assembly of the coupler (11)—reinforcement bar (2) is then pushed in a manner to start the automatic connection cycle and traction test. Once the cycle is complete, the assembly of the coupler (11)—reinforcement bar (2) is removed from the device (61). In the case of a destructive or unfavorable test, the assembly of the coupler (11)—reinforcement bar (2) is removed manually broken apart.

The connection device (61) according to the invention allows, by an automatic functioning, obtaining completely assured connections by connecting the couplers (11) onto the reinforcement bar (2).

Based on the invention, once the reinforcement bar (2), on which the coupler (11) is fitted, is inserted into the device (61), the threaded part (8) of the coupler (11) comes to stop against the threaded joint tool (62). The operator then exerts an additional push on the reinforcement bar (2) which generates an elastic recoil of the shaft (33) relative to the intermediate chamber (78). This translation of the shaft (33) can be absorbed by a pneumatic or hydraulic cylinder (63) preferably placed between the upper end (36) of the shaft (33) and the end of the transmission shaft (86).

The position sensor (76) goes into the resting positions as soon as the upper end (36) of the shaft (33) has translated.

When the upper end (36) reaches the position sensor (75), the position sensor is activated and starts the motor (69) turning.

the motor (69) drives by way of the transmission shaft (86), the shaft (33) and the threaded joint tool (62). The threaded part (8) of the coupler (11) begins to be threaded on the threaded joint tool (62).

At the end of the threaded joint of the coupler after the start of the motor (69), the radial translation jacks (65) ensure the closing of the female molds (64) on the circumference of the reinforcement bar (2). The two female molds (64) are then positioned to stop on the coupler (11) base by pushing the push jacks (66).

Positioning the female molds (64) to contact on the base of the coupler (11) ensures the perfect fitting of the reinforcement bar (2) at the bottom of the hollow cylindrical part (90) of the coupler (11). The reinforcement bar (2) is driven by the female molds (64) lightly pressing.

The coupler (11) thus comes into a position where its neck (31) is completely engaged in the die (67). At the end of the threaded joint of the threaded part (8), the shaft (33) is completely returned to recoiled position which reactivates the position sensor (76). Once stopped at the level of the should (48), the shaft (33) induces an increase of the motor torque (69). The motor rotation is interrupted for example, via an integrated manocontact. Any displacement of the shaft (33) opposite the intermediary piece (78) is thus blocked.

In order to support the reinforcement bar (2), the vice (71) is thus controlled by the control jack (72). The control jack (72) induces the translation of the clamping jaws (81) which come to support on the diameter of the reinforcement bar (2).

The extrusion operation then begins. In order to do it, the displacement of the die (67) is carried out by translation of the extrusion jack (73) which induces a displacement of the die (67) and of the die holder (68) along the axis of the coupler (11). Guides (82) make it possible in a particular embodiment form to ensure good orientation of the displacement of the die (67).

During extrusion, the push jacks (66) exert a force on the coupler base (11) which is opposite to the extrusion force exerted by the die (67). In order to keep the force of the counter-pressure constant, the push jacks (66) can translate in a manner to bring back or advance the female molds (64).

The counter-pressure mechanisms (64,65,66) have the advantage of controlling the elongation of the metal of the coupler (11) and of guaranteeing the constancy of the modifications of the mechanical characteristics of the steel which makes up the coupler (11). Thus, if the diameter of the reinforcement bar (2) is greater than its theoretical value, the force of the die (67) increases, which produces an immediate backward movement of the molds (64) by way of the push jacks (66). The elongation of the metal of the coupler (11) is thus more sizable. If on the other hand, the diameter of the reinforcement bar (2) is less than its theoretical value, the force produced by the die (67) is less significant and does not produce the backward movement of the female molds. The elongation of the metal which makes up the coupler is thus less sizable.

At the end of the extrusion, the die (67) comes to push on the female molds (64) and drives a backward movement of the push jacks (66). Once the push jacks (66) stop, the force exerted by the extrusion jacks (73) increases in a fast manner. The pressure corresponding in the extrusion jacks (73) is such that it starts resetting the extrusion jacks (73) to zero.

The extrusion jacks (73) then come back into the starting position. The female molds (64) are then or at the same time brought out of the circumference of the reinforcement bar (2) by control of the radical translation jacks (65).

The stress mechanisms (74) are then activated in order to perform the traction test. The intermediary piece (78) translates progressively relative to the external envelope (35) by driving the shaft (33) by its should (48). This displacement continues until a preset load level corresponding to a control pressure of the displacement of the intermediary piece (78) in the external envelop (35).

In one form of the invention, the data of the traction force and displacement of the intermediary piece (78) are put into memory in such a way so as to ensure an optimal traceability of each connection of coupler (11)—reinforcement bar (2).

In the case where Programmable Logic Controller controls the performance of a destructive test, this test is started and is continued until the rupture of the rod.

Following a destructive test, the automatic cycle directed by the Programmable Logic Controller continues by the deactivation of the vice (71). This deactivation is carried out by control of the control jack (72). The unscrewing of the coupler (11) can then be done manually, all the instruments of the device (61) having been previously reset to zero in an automatic manner.

Following a non-destructive traction test, the device (61) carries out the unscrewing of the coupler (11).

The resetting to zero of the control pressure of the stress mechanisms (74) starts the rotation of the motor (69) in the opposite direction to that of the threads. In driving by way of the shaft (33) of the transmission (86), the motor (69) allows the coupler to be unscrewed (11). Once the unscrewing has been done, the control jack (72) of the vice (71) is decompressed in a manner to release the reinforcement bar (2) from the grip of the clamping jaws (81). The reinforcement bar (2) on which the coupler (11) has been inserted and whose connection has been checked, can then be extracted from the device (61) in a manual manner by the operator.

If the non-destructive test is unfavorable, i.e. if the traction force does not reach its preprogrammed value, the stress mechanisms (74) continue their action until the total separation of the coupler (11) and the bar (2). The coupler (11) is then not usable.

In the particular embodiment form of the invention where a return movement jack (80) is used, the jack is activated prior to the complete manual operation and allows returning to a stop the intermediary piece (78) and the shaft (33).

All of the instruments composing the device (61) for the connection of the couplers (11) on the reinforcement bar (2) are then brought back into the initial position and it is possible to continue to a new cycle of connection and traction test.

The invention presented here can also be applied to other products than the reinforcement bars and, for example, to the smooth bars to be mounted, the end of which being previously blazed by a mechanical mechanism or by the pressure of a mold.

What is claimed is:

1. A device for coaxially connecting a coupler to a concrete reinforcement bar, wherein the coupler has a first end, a second end, a hollow cylindrical portion extending from the first end toward the second end, and a threaded portion extending from the second end towards the first end, and wherein the concrete reinforcement bar is received within the hollow cylindrical portion, the device comprising:

a frame structure;

a joint tool means for threadably engaging said threaded portion of said coupler;

a hollow jack body connected to and supporting said joint tool means, and received within said frame structure;

an extrusion tool connected to said frame structure and surrounding said joint tool means;

a translation means connected to said extrusion tool, said translation means for moving said extrusion tool relative to said joint tool means along and against said hollow cylindrical portion towards said first end, such that said extrusion tool radially constricts said hollow cylindrical portion of said coupler into engagement with said concrete reinforcement bar while axially elongating said hollow cylindrical portion; and a counterpressure means connected to said frame structure, said counterpressure means for exerting a dynamic force directly against said first end of said coupler towards said second end while said extrusion tool is moving along and against said hollow cylindrical portion towards said first end, whereby said counterpressure means controls the extent to which said hollow cylindrical portion is radially constricted and axially elongated.

2. The device of claim 1, and further comprising a self-check means connected to said jack body and to said joint tool means, said self-check means for checking a quality of the engagement of said coupler with said concrete reinforcement bar by exerting a force on said joint tool means in a direction that is opposite to the direction of movement of said extrusion tool along and against said hollow cylindrical portion.

3. The device according to claim 1, wherein said counterpressure means comprises:

first and second members each having a top surface and a concave side surface;

a moving means connected to each of said first and second members, respectively, said moving means for moving said first and second members towards one another such that said concave side surfaces cooperate with one another and form an opening that corresponds generally in shape to a cross-sectional shape of said concrete reinforcement bar;

a push jack means connected to said first and second members for translating said first and second members along a longitudinal axis of said coupler toward said first end, whereby said dynamic force is exerted to said first end when said top surface of each of said first and second members comes into contact with said first end; and a control means for controlling the dynamic force exerted by said first and second members by causing said push jack means to translate said first and second members towards and away from said first end.

* * * * *